US008075358B2

(12) United States Patent
Yesil et al.

(10) Patent No.: US 8,075,358 B2
(45) Date of Patent: Dec. 13, 2011

(54) DREAM WALK ON THE WATER

(76) Inventors: Sadik Yesil, McMinnville, TN (US); Nevriye Amanda Yesil, McMinnville, TN (US)

( * ) Notice: Subject to any disclaimer, the term of this patent is extended or adjusted under 35 U.S.C. 154(b) by 283 days.

(21) Appl. No.: 12/272,673

(22) Filed: Nov. 17, 2008

(65) Prior Publication Data

US 2009/0130932 A1 May 21, 2009

Related U.S. Application Data

(60) Provisional application No. 60/988,555, filed on Nov. 16, 2007.

(51) Int. Cl.
*B63B 35/83* (2006.01)

(52) U.S. Cl. ..... 441/76

(58) Field of Classification Search ..... 441/77, 441/76; 440/76, 77
See application file for complete search history.

(56) References Cited

U.S. PATENT DOCUMENTS

| | | | | |
|---|---|---|---|---|
| 22,457 | A | 12/1858 | Rowlands | |
| 2,248,307 | A * | 7/1941 | Richards et al. | 441/76 |
| 2,694,209 | A | 11/1954 | Lippincott | |
| 3,121,892 | A | 2/1964 | Plumlee | |
| 3,621,500 | A | 11/1971 | Senghas | |
| 3,747,236 | A | 7/1973 | Sidlauskas | |
| 3,751,030 | A * | 8/1973 | Winters | 472/129 |
| 3,756,187 | A | 9/1973 | Livaudais | |
| 3,835,494 | A * | 9/1974 | Dougherty | 441/77 |
| 4,261,069 | A | 4/1981 | Schaumann | |
| 4,305,143 | A * | 12/1981 | Simms et al. | 367/134 |
| 4,915,659 | A | 4/1990 | Sanders | |
| 5,174,220 | A * | 12/1992 | Skedeleski et al. | 114/219 |
| 5,277,636 | A * | 1/1994 | Seith | 441/77 |
| 5,593,334 | A | 1/1997 | Thayer | |
| 5,643,029 | A | 7/1997 | Rudofsky | |
| 6,213,830 | B1 | 4/2001 | Robinson | |
| 6,469,641 | B1 * | 10/2002 | Lash et al. | 340/984 |
| 6,855,024 | B2 | 2/2005 | Rothschild | |
| 6,939,187 | B1 | 9/2005 | Borroto | |
| 7,083,482 | B2 * | 8/2006 | Bouge et al. | 440/1 |
| 7,335,077 | B2 * | 2/2008 | Chiappetta | 441/80 |
| 7,361,071 | B1 | 4/2008 | Lauren | |
| 2003/0017769 | A1 | 1/2003 | Rosen | |

* cited by examiner

*Primary Examiner* — Stephen Avila
(74) *Attorney, Agent, or Firm* — Kenneth W. Bower

(57) ABSTRACT

Disclosed are floats that allow forward motion while a user is standing erect on the surface of a body of water. Increased stability as well as the appearance of aquatic creatures enhance friendliness for beginning users. Design features provide additional performance and challenge for the advanced user. Handles resist falling of the user and provide added buoyancy should a fall occur.

21 Claims, 4 Drawing Sheets

DREAM WALK ON THE WATER

CROSS-REFERENCE TO RELATED APPLICATIONS

This application claims U.S. Provisional Application No. 60/988,555 filed Nov. 16, 2007.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The field of the present invention is amusement and exercise devices for use at the beach.

2. Description of Related Art

There is currently a large skill gap between inner tube floating on the water and water skiing or surf boarding. The lightweight, easy to use pontoons with balance handles that are tethered together make the present invention an ideal starter device to fill this skill gap for future water skiers or surf boarders. Traditional sources of bodily harm to users due to falling off of or upending the device requires attention. And, there are also concerns to be addressed to reduce the potential for user harm in today's climate induced and social environment to carry a user out to sea or off in an abduction.

Further, it is well-known that devices tethered together can support an adult above the water in an erect position where a walking motion produces forward movement.

The device of Rowlands (U.S. Pat. No. 22,457, Issued Dec. 28, 1858) is a prime example of an early entrant into water walking technology. Rowlands discloses two mutually tethered pontoons with erect handles. However, Rowlands presents a number of opportunities for bodily harm due to lack of foot holders, the potential for sharp or rigid surfaces impacting a user in the case of a fall, lack of land based monitoring and need for the novice to learn on a fully functional device.

The device of Schaumann (U.S. Pat. No. 3,936,897, issued Feb. 10, 1976) adds a second way of tethering the pontoons together to provide a functional easier to use device configuration for the novice, but lacks the erect handles of Rowlands in addition to a number of opportunities for harm to a user due to lack of foot holders, the potential for sharp, rigid surfaces impacting on a user in case of a fall and lack of land based user monitoring.

The device of Robinson (U.S. Pat. No. 6,213,830, issued Apr. 10, 2001) improved over Rowlands by adding foot holders on the top surface of the pontoons, however, it lacks rigid attachment of the handles to the pontoons and additionally presents a number of opportunities for user harm due to the potential for sharp, rigid surfaces impacting on a user in case of a fall, lack of land based monitoring and need for the novice to learn on a fully functional device configuration.

The device of Lauren (U.S. Pat. No. 7,361,071, issued Apr. 22, 2008 overcomes the potential for sharp rigid surfaces impacting the body of a falling user with site inflatable pontoons. However, Lauren lacks rigidly attached low impact handles and presents a number of opportunities for bodily harm to a user due to lack of land based monitoring and need for the novice to learn on a fully functional device configuration.

BRIEF SUMMARY OF THE INVENTION

In view of the above-mentioned unfulfilled needs in the prior art, the present invention embodies, but is not limited by, the following objects and advantages:

It is an objective of the present invention to provide a device for amusement and exercise on a body of water, It is a further objective of the present invention to provide proper geometry of the pontoons to tend to stay in an upright position.

It is a further objective of the present invention to provide a device that can be used by a novice user at a first level of performance and an experienced user at a second level of performance.

It is a further objective of the present invention to provide an amusement device that supports a user in an erect position on top of the water in the first level of performance.

It is a further objective of the present invention to provide an amusement device that allows a user to move their legs in a walking motion on top of the water in the second level of performance.

It is a further objective of the present invention to lessen the risk of injury to a rider in case of falling onto the surfaces of the water walker by making such surfaces of an inflated, flexible material.

It is a further objective of the present invention to provide for a kit that includes instructions for best use of the features that reduce the risk of injury to a user. Also, to motivate the user to wear the flotation device by styling that is consistent with the motif of the water walker.

It is a further objective of the present invention to provide components that prevent inadvertent user immobility due to entrapment in the water walker.

It is a further objective of the present invention to provide wireless monitoring and alarms warning of conditions that increase the probability of harm to either the user or the water walker.

It is a further objective of the present invention to provide connection devices that pose no threat of puncturing the pontoons when either attached or unattached.

The preferred embodiment of the present invention is a flotation device that permits traversing over the top of a body of water in a normal walking motion. The device consists essentially of two flotation devices: a left pontoon and a right pontoon. Both pontoons are gas filled, providing bouyancy. The two pontoons are releasably attached to each other by a connector assembly. In addition, each pontoon has an upright grab handle for the occupant to hold, and a foot holder with a foot holder for securing the occupant's feet.

In the preferred embodiment, each pontoon takes the shape of an aquatic creature, such as a dolphin. For added amusement, and safety, the occupant is supplied with matching simulative buoyant vest.

The present invention provides a number of features to reduce the potential of user harm and construction features that teach well beyond the prior art. As an example, the invention may be used in three different modes by manipulating the connector assembly. For example, in the close connection mode, the two pontoons may be directly attached to each other without the use of the connector assembly. By limiting the distance between the pontoons in this close connection mode, the occupant may easily mount the device from either side without rolling one of the pontoons over.

In a long connection mode, the two pontoons may be connected with the connector assembly, which is essentially made of multiple spring clips, ropes and netting. When attached with the connector assembly, the present invention may be operated as a water walking device. In addition, the presence of netting will provide the safety benefit of catching the occupant, should he or she fall between the pontoons.

In an unconnected mode, the two pontoons may be detached from each other, and be used by two independent users as flotation devices.

When being used in the long connection mode, the occupant holds a handle assembly that is attached to the top of each pontoon. Each handle assembly has a grab handle which is held by the occupant while traversing over the water. The attachment between each pontoon and the grab handle is cone shaped. The cone shaped handle portion provides large surface area of attachment to each pontoon for the purpose of stability to the handle assembly. In addition, the cone shaped handle portion is hollow and sealed in the center, providing for buoyancy to the handle assembly. Consequently, the pontoons will tend not to completely roll over in the water.

For additional stability, the two pontoons have a substantially flat bottom and width to height ratios of at least 1.5. Both of these factors provide for resistance against tipping.

The embodiments and objects herein described are illustrative and not intended to be exhaustive. Other versions, methods and devices can be realized by a person having ordinary skill in the art through insightful reflection and through the practice of the present invention.

BRIEF DESCRIPTION OF THE SEVERAL VIEWS OF THE DRAWING(S)

Various other objects, features and attendant advantages of the present invention will become fully appreciated through consideration of the accompanying drawings and the detailed description following, in which like reference characters designate the same or similar parts throughout the several views, and wherein.

DETAILED DESCRIPTION OF THE INVENTION

Figure 1:
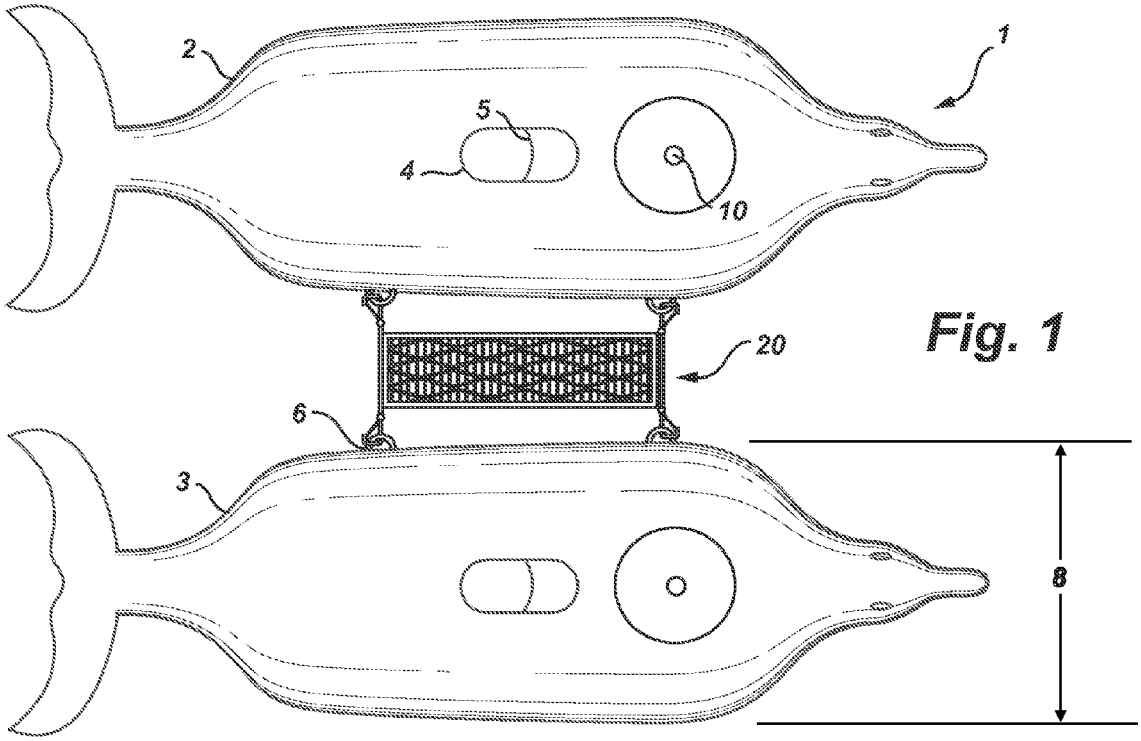
FIG. 1 is a top plan of view of the present invention.
Figure 2:
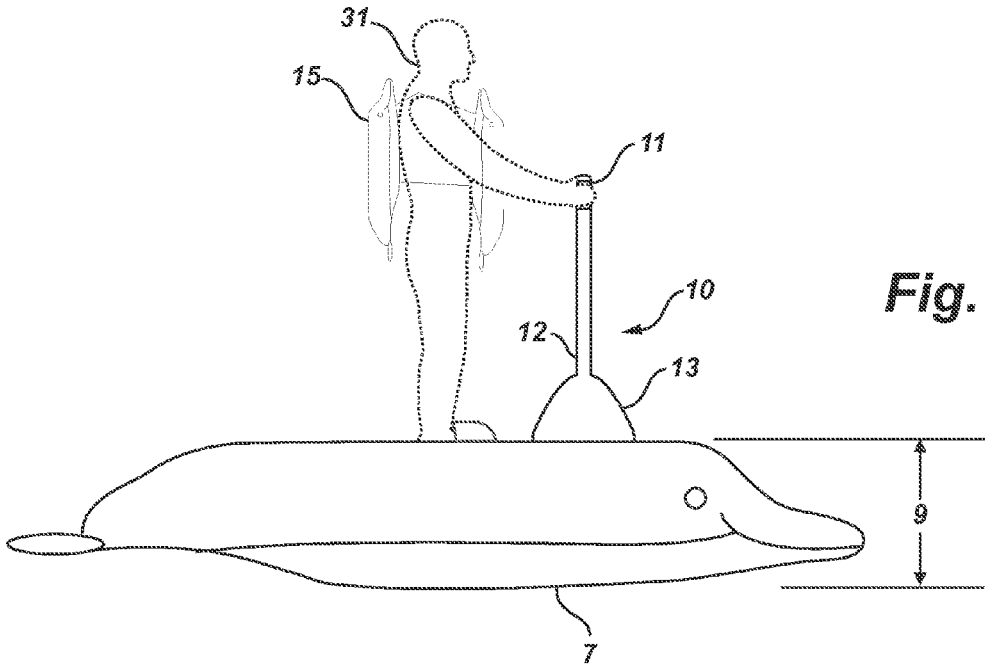
FIG. 2 is a side plan of view of the present invention.

Referring now to FIG. 1-2, a water walker 1 is shown in the long connection mode. As seen the water walker 1 is composed of a left pontoon 2 and a right pontoon 3. The left pontoon 2 is releasably attached to the right pontoon 3 by a connector assembly 20 or second connecting device. Moreover, the left pontoon 2 and the right pontoon 3 each have a handle assembly 10, or integral handle and a foot holder 4, or adjustable foot holder. Each foot holder 4 has an adjustable foot holder 5 for securing the occupant feet in place. In addition the occupant is supplied with a simulative buoyant vest 15, or user flotation device, which provides both amusement and safety should the occupant fall off the water walker 1.

The handle assembly 10 has a grab handle 11 which can be held by the occupant while traversing over the water. The grab handle 11 is attached to an elongated handle portion 12, which connects to a cone shaped handle portion 13. The cone shaped handle portion 13 provides large surface area of connection to the left pontoon 2 and the right pontoon 3 for the purpose of providing stability to the handle assembly 10. In addition, the cone shaped handle portion 13 is hollow and sealed in the center, which provides buoyancy to the handle assembly 10 independent of the buoyancy of the left pontoon 2 or the right pontoon 3. Consequently, the left pontoon 2 and the right pontoon 3 will tend not to completely roll over in the water.

As seen in FIG. 1, the connector assembly 20 is attached releasably to the left pontoon 2 and to the right pontoon 3. Both the left pontoon 2 and the right pontoon 3 have an attachment eyelet 6. The attachment eyelet 6 is a semi-rigid ring shaped device used to connect the rope attached hook 21, that is connected to either end of the connector assembly 20.

Referring to FIG. 2, the left pontoon 2 and the right pontoon 3 have a substantially flat bottom 7. The substantially flat bottom 7 provides greater stability of each pontoon against tipping. Moreover each pontoon has a pontoon width 8 and a pontoon height 9, wherein the ratio of the pontoon width 8 to the pontoon height 9 is at least 1.5. This minimum 1.5 ratio provides greater stability against tipping.

Figure 3:
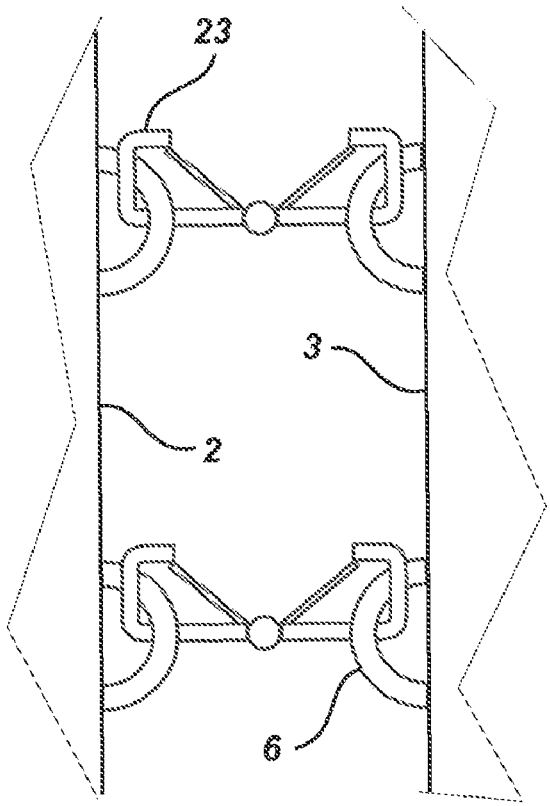
FIG. 3 is a top view of the connector assembly shown in the close connection mode.

Referring now to FIG. 3, the close connection mode is shown. As seen the left pontoon 2 has a close connection hook 23, or first connecting device, attached to the attachment eyelet 6. The close connection hook 23 can be releasably attached to the attachment eyelet 6 on the right pontoon 3.

Figure 4:
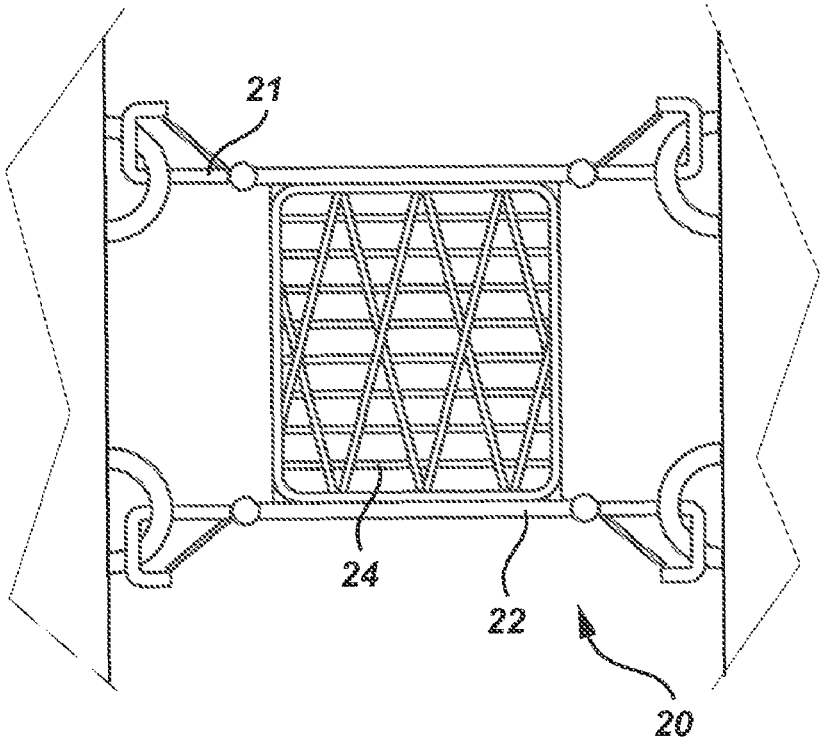
FIG. 4 is a top view of the connector assembly shown in the long connection mode.

Referring now to FIG. 4, the long connection mode is shown. As seen the connector assembly 20 has four of the rope attached hook 21 and two connector ropes 22. Since the connector rope 22 is composed of flaccid material, the left pontoon 2 and the right pontoon 3 can move toward each other, but may not move away from each other by a distance greater than the length of the connector assembly 20. In addition, the two connector rope 22 is attached to each other by a netting 24. The netting 24 provides the potential safety enhancement of capturing the occupant if he or she falls between the left pontoon 2 and the right pontoon 3.

Figure 5:
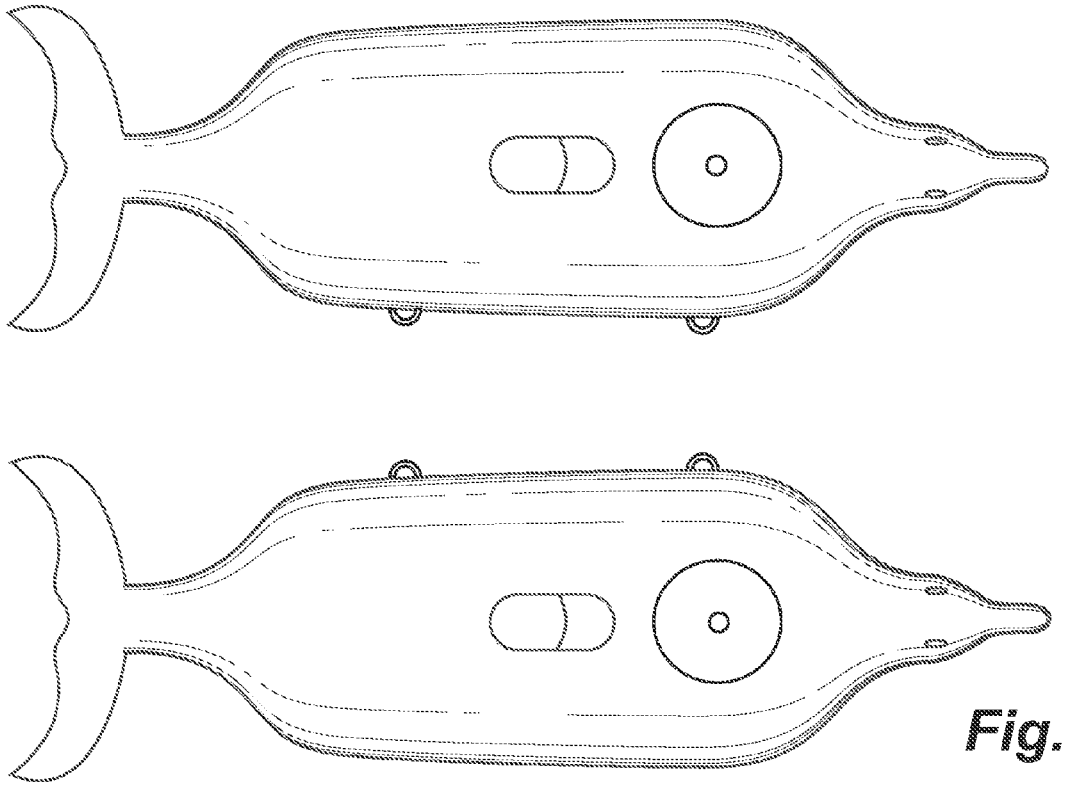
FIG. 5 is a top plan view of the present invention shown in disconnected mode.

Referring now to FIG. 5, the water walker 1 is shown in the detached mode. As seen, the left pontoon 2 is completely detached from the right pontoon 3, enabling two occupants to use each pontoon as independent flotation devices.

Figure 6:
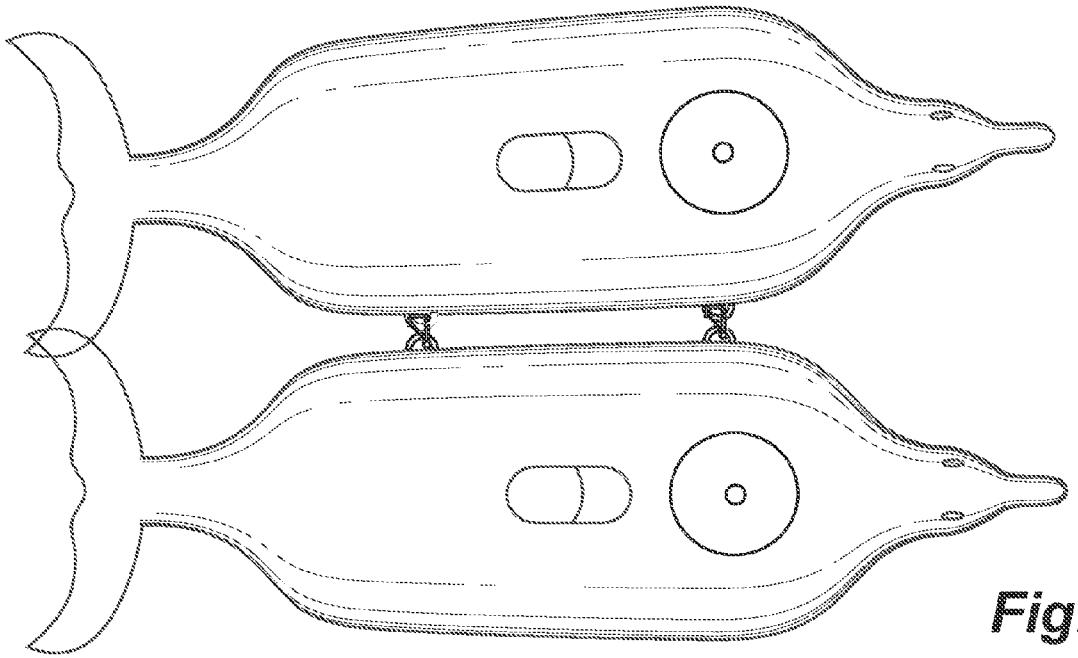
FIG. 6 is a top plan view of the present invention shown in the close connection mode.

Referring now to FIG. 6, the water walker 1 is shown in the close connection mode. As seen, the left pontoon 2 is closely attached to the right pontoon 3, enabling the occupant to easily mount the water walker 1.

Figure 7:
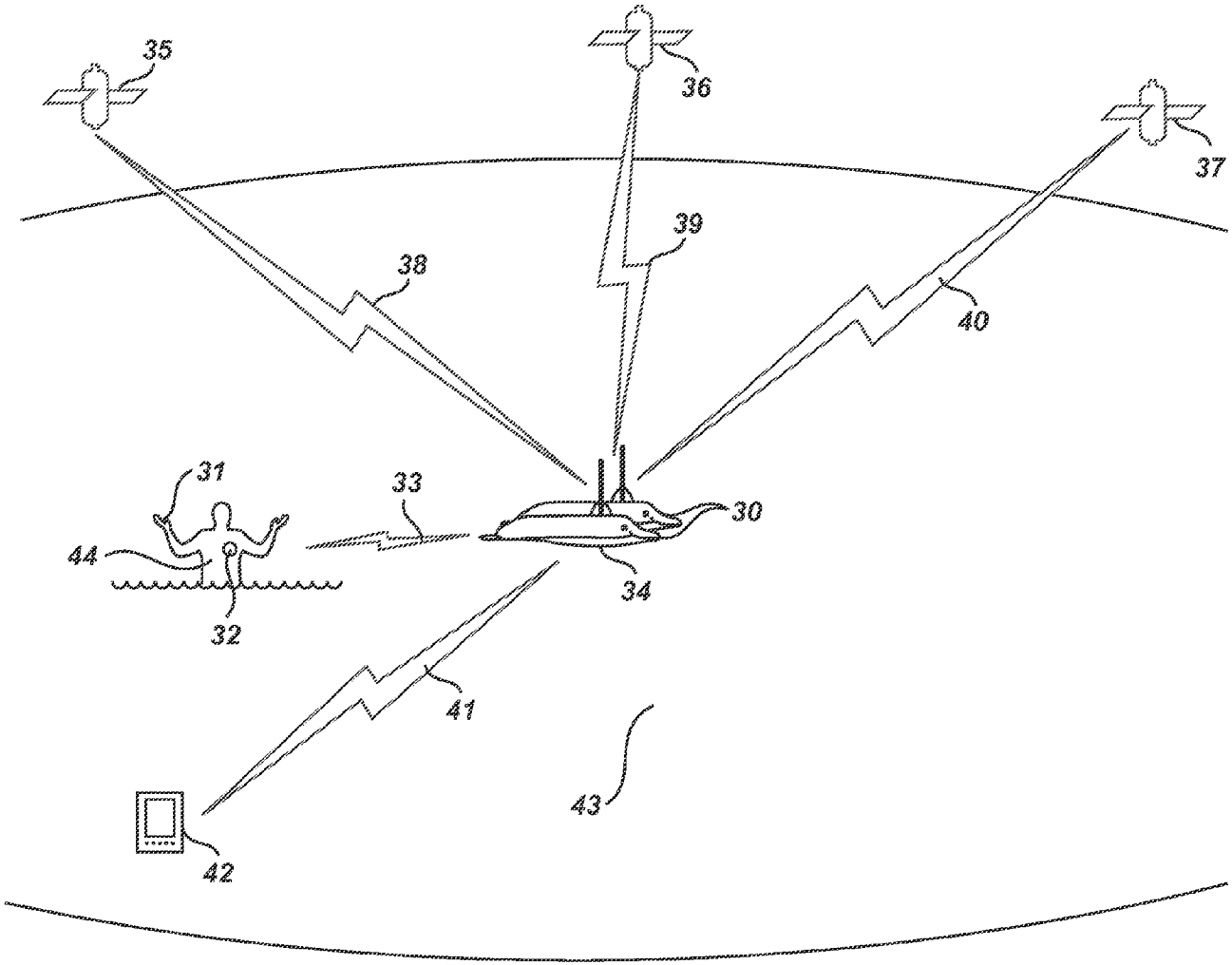
FIG. 7 is a perspective view of the present invention shown with wireless monitoring an alarm features.

Referring now to FIG. 7, the present invention provides additional features that reduce the risk for the rider by use of a remote monitoring system called a GPS 34 (Global Positioning System). A series of satellites 31, 32, and 33 surround the earth in a stationary orbit. The water walker 1 floating in body of water 43 is equipped with a GPS 34 that receives wireless signals 38, 39 and 40 from the satellites 35, 36, and 37. The GPS 34 uses the coordinates of the satellites 35, 36 and 37 to calculate the exact position of the GPS 34 and the water walker 1. The position of the water walker 1 is then transmitted wirelessly 41 to a remote monitor and alarm system 42 located on land bordering body of water 43. The monitor and alarm system 42 is pre-programmed with the coordinates of the area within which the rider 31 should limit travel. The monitor and alarm system 42 sounds an alarm when the water walker 1 and the GPS 34 return coordinates outside of the pre-programmed area.

The GPS 34 is also equipped with a proximity sensor. The rider 31 of the water walker 1 has a magnet 32 on their flotation device 44. Should the rider 31 fall from the water walker 1 the proximity sensor in the GPS 34 will sense that the magnet is no longer in close proximity to the GPS 34 and send another signal wirelessly 41 to the monitor and alarm system 42 alerting someone on the ground surrounding the body of water 43 that there is a potentially dangerous situation for the rider 31. Similarly the monitor and alarm system can calculate the speed of movement of the GPS 34 and the water walker 1 and sound an alarm when the speed exceeds a pre-set limit. Excessive speed can indicate that the wind, current, rip-tide or an assailant are controlling the motion of the water walker 1 or the rider 34, posing a danger to the rider 31.

It is to be understood that the invention is not limited in its application to the details of construction and to the arrangements of the components set forth in the preceding description or illustrated in the drawings. The invention is capable of other embodiments and of being practiced and carried out in various ways. Also, it is to be understood that the phraseology and terminology employed herein are for the purpose of the description and should not be regarded as limiting.

The invention claimed is:

1. A water walker for child safety, comprising:
a first pontoon that is gas filled, resilient and buoyant;
a second pontoon that is gas filled, resilient and buoyant;
a foot holder made of resilient materials that can be set to release a user's foot at a safe level that is rigidly attached to the first pontoon and the second pontoon;
an integral handle, that is gas filled, resilient, and rigidly attached to each of the first pontoon and the second pontoon;
a connecting device that tethers the first pontoon adjacent the second pontoon for use by novice riders.

2. The water walker for child safety of claim 1, further comprising:
a second connecting device that tethers the first pontoon a fixed distance from the second pontoon for parallelogram motion, wherein the second connecting device provides a barrier to a user's inadvertent entry to an opening between the first pontoon and the second pontoon.

3. The water walker for child safety of claim 1, wherein:
the first pontoon and the second pontoon are simulative of a dolphin known as a symbol of leading the way to safety.

4. The water walker for child safety of claim 2, wherein:
the first pontoon and the second pontoon are simulative of a dolphin known as a symbol of leading the way to safety.

5. The water walker for child safety of claim 1, further comprising:
a wireless device that warns of an unsafe condition existing on the water walker.

6. The water walker for child safety of claim 1, further comprising:
one or more wireless devices that warn of one or more of:
a severe change in attitude of the water walker;
an entry of the user into the water;
a movement of the user away from the pontoons;
a sudden change of location of the water walker or user;
a movement of the water walker beyond a preset distance;
a rider triggered alarm.

7. The water walker for child safety of claim 1, wherein:
the first connecting device is detachable from either the first pontoon or the second pontoon without tools.

8. The water walker for child safety of claim 1, further comprising:
a wireless device that warns of an unsafe condition existing on the water walker.

9. The water walker for child safety of claim 8, further comprising:
one or more wireless devices that warn of a severe change in attitude of the water walker.

10. The water walker for child safety of claim 8, further comprising:
one or more wireless devices that warn of an entry of the user into the water.

11. The water walker for child safety of claim 8, further comprising:
one or more wireless devices that warn of a movement of the user away from the pontoons.

12. The water walker for child safety of claim 8, further comprising:
one or more wireless devices that warn of a sudden change of location of the water walker or user.

13. The water walker for child safety of claim 8, further comprising:
one or more wireless devices that warn of a movement of the water walker beyond a preset distance.

14. The water walker for child safety of claim 8, further comprising:
one or more wireless devices that warn of a rider triggered alarm.

15. The water walker for child safety of claim 3, further comprising:
a wireless device that warns of an unsafe condition existing on the water walker.

16. The water walker for child safety of claim 15, further comprising:
one or more wireless devices that warn of a severe change in attitude of the water walker.

17. The water walker for child safety of claim 15, further comprising:
one or more wireless devices that warn of an entry of the user into the water.

18. The water walker for child safety of claim 15, further comprising:
one or more wireless devices that warn of a movement of the user away from the pontoons.

19. The water walker for child safety of claim 15, further comprising:
one or more wireless devices that warn of a sudden change of location of the water walker or user.

20. The water walker for child safety of claim 15, further comprising:
one or more wireless devices that warn of a movement of the water walker beyond a preset distance.

21. The water walker for child safety of claim 15, further comprising:
one or more wireless devices that warn of a rider triggered alarm.

* * * * *